US005154626A

United States Patent [19]

Watson

[11] Patent Number: 5,154,626

[45] Date of Patent: Oct. 13, 1992

[54] DOUBLE-HELIX ZERO INSERTION FORCE CONNECTOR SYSTEM

[76] Inventor: Troy M. Watson, 5672 E. Kelso St., Tucson, Ariz. 85712

[21] Appl. No.: 815,510

[22] Filed: Jan. 2, 1992

[51] Int. Cl.[5] ..... H01R 13/00

[52] U.S. Cl. ..... 439/268; 439/841

[58] Field of Search ..... 439/266, 268, 841

[56] References Cited

U.S. PATENT DOCUMENTS

| | | | |
|---|---|---|---|
| 2,997,681 | 8/1961 | Klassen | 439/268 |
| 3,559,155 | 1/1971 | Frey | 439/268 |
| 4,192,567 | 3/1980 | Gomolka | 439/268 |

*Primary Examiner*—Joseph H. McGlynn
*Attorney, Agent, or Firm*—J. E. McTaggart

[57] ABSTRACT

A zero insertion force type connector system provides a receptacle with variable inside diameter for typical use in cooperation with a solid elongated pin, typically or round cross-section, as the opposite member of a mating connector pair. The receptacle is configured as a double-helix formed from a single length of wire which may be a stripped length of insulated hookup wire thus providing two integrally connected insulated leads for highly reliable external interconnections, which may include coaxial cables. The double-helix is formed into a diametric loop at one end of the double-helix, and the other end is constrained against rotation by a pair of leads emerging at diametrically opposite sides captured within conduit slots of a protective insulated casing. The loop is engaged and rotationally driven by a slotted drive head to vary the inside diameter of the receptacle, typically expanding it to provide zero insertion force during pin entry, following which, upon removal of the external drive head torque, internal spring tension of the wire causes the coils of the double-helix to grip the pin and provide electrical contact pressure. Alternatively part of all of the total contact pressure may be provided from an external torque source via the drive head and the loop, preferably including resilient linkage such as spring lever arms to maintain constant torque, and particularly in the case of multiple contact connector assemblies, to evenly distribute torque to multiple double-helix receptacles.

12 Claims, 6 Drawing Sheets

DOUBLE-HELIX ZERO INSERTION FORCE CONNECTOR SYSTEM

FIELD OF THE INVENTION

The present invention relates to the field of electrical connectors and more particularly, within the class of connector characterized as ZIF (zero insertion force), it relates to structure, manufacture and use of a novel ZIF connector system, utilizing a double-helix female receptacle formed integrally with interconnection wiring.

BACKGROUND OF THE INVENTION

Electrical connectors intended to be repeatedly coupled and decoupled commonly utilize spring loaded contacts in one or both members of mating pairs; without special provision such spring loading inherently involves a compromise between contact reliability and required insertion force. Consequently a special class of connectors has evolved, designated ZIF (zero insertion force), wherein the contact pressure may be temporarily withheld during coupling or decoupling. Typically, where the receptacle (female) member is spring loaded to engage a solid pin (male) member, ZIF is implemented by causing a temporary enlargement of the effective inside diameter of the receptacle so as to disengage the pin during insertion or removal.

There is an ongoing and unfulfilled need for improved ZIF connector systems for electronic circuitry, especially for simple and reliable configurations which are adaptable to multiple actuating/release mechanisms.

DISCUSSION OF PRIOR ART

Spring coils in a single helical configuration have been utilized in various ways as variable diameter clamping elements in connector devices and the like as exemplified in the following U.S. patents: U.S. Pat. No. 4,874,909 to Velke Sr. et al, U.S. Pat. No. 3,295,872 to Kragle, U.S. Pat. No. 4,192,567 to Gomolka, U.S. Pat. No. 4,082,399 to Barkhuff, U.S. Pat. No. 3,518,614 to Nyberg, U.S. Pat. No. 2,427,001 to Hubbell et al and U.S. Pat. No. 3,440,333 to Blomstrand.

The above and other ZIF implementations of known art utilizing a single coil contact configuration generally require a relatively complex release mechanism due to inherent imbalance of the single coil configuration; furthermore, in prior art the coil contacts are discrete entities and are not formed from the integral connecting wire. The ability to utilize a continuous length of wire with no transitions or junctions provides a more uniform characteristic impedance distribution within the interconnection and improves the structural strength and reliability of the connector.

A double-helix configuration formed directly from hookup wire has been utilized as a circuit board terminal post by Rayburn in U.S. Pat. Nos. 2,948,953 and 3,022,369, disclosing a method and article of manufacture respectively.

U.S. Pat. No. 5,024,146, issued to the present inventor on Aug. 27, 1991, discloses the forming of interconnecting hookup wire into a double-helix configuration, directed primarily to serving as a receptacle cavity for receiving component leads or other hookup wire ends for soldering and providing integrally connected point-to-point hookup wiring alternative to printed circuit traces.

In the abovementioned and other known art, while single helical coils have been utilized to implement variable diameter receptacles in ZIF connectors, the use of the double helical configuration has been confined to fixed diameter devices such as posts or terminals captivated in a circuit board and thus incapable of diameter variation.

OBJECTS AND SUMMARY OF THE INVENTION

It is a primary object of the present invention to provide an improved ZIF connector receptacle whose inside diameter may be varied by a simple mechanism in a manner to provide a disengaged mode allowing free entry and withdrawal of a mating contact pin and an engaged mode wherein the receptacle remains securely clamped in secure electrical and mechanical engagement with the pin.

It is a further object that the ZIF connector receptacle be formed directly from interconnecting hookup wire.

The above and other objects have been met by the present invention which exploits unique features of the double-helix enabling this configuration to serve as an improved ZIF connector receptacle with integral hookup wiring. One end of a double-helix having two interleaved helical coils is formed into an integral link or loop transversing the coils diametrically and connecting them together, while the two interconnecting leads are brought out at the second end. With the second end suitably constrained, the inside diameter of the double-helix may be varied by rotationally driving the other end via the loop. The resilience of the wire material may be utilized, with or without external assisting force means, to spring load the double-helix in a manner to provide secure clamping engagement with the mating pin, along with the ability to release the double-helix for insertion or removal of the pin by applying torque to the loop end.

BRIEF DESCRIPTION OF THE DRAWINGS

The manufacture, structure, operation and further advantages of the double-helix as a ZIF connector in accordance with the present invention will be more fully understood from the following description taken along with the accompanying isometric drawings in which.

DETAILED DESCRIPTION

Figure 1:
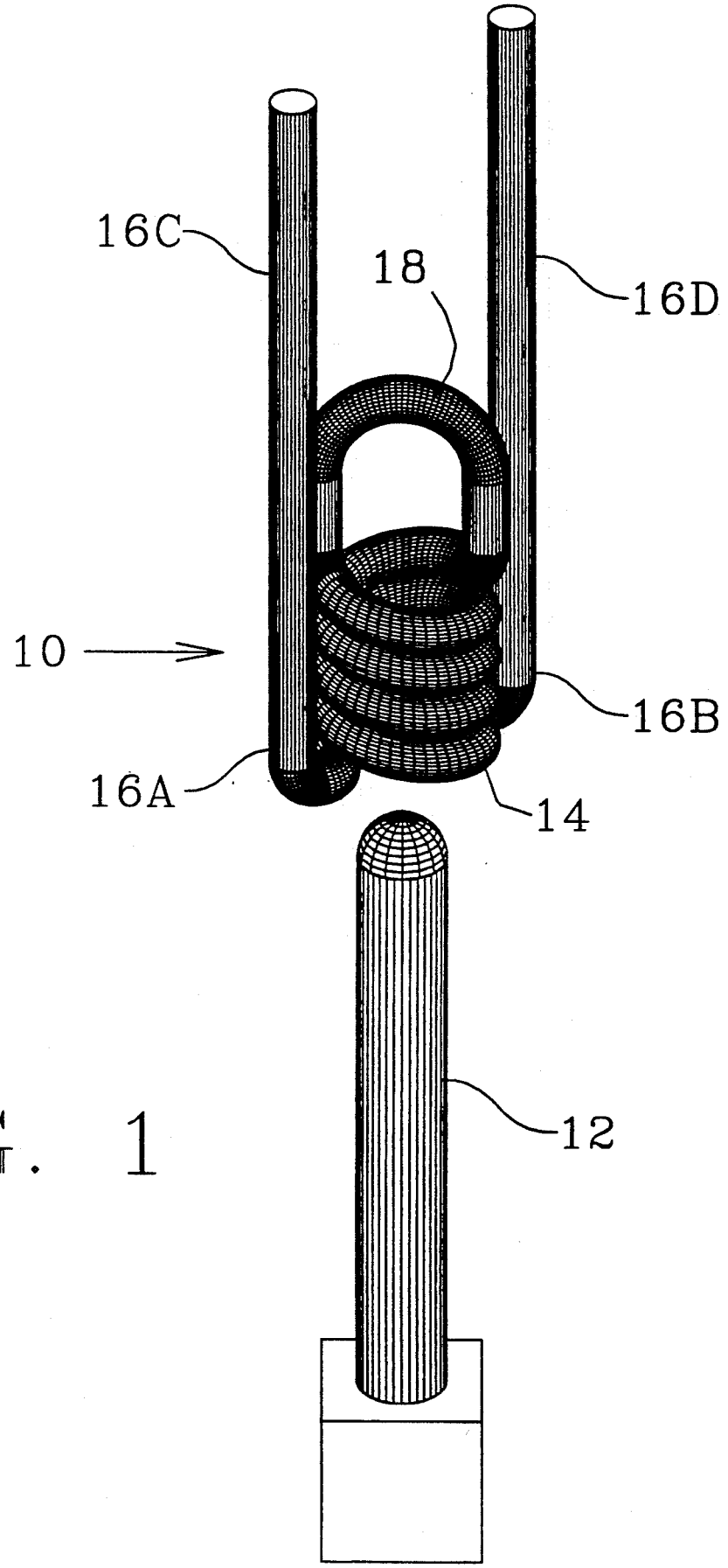
FIG. 1 shows a basic double helical receptacle and a mating pin configured in accordance with the present invention, in a fully disengaged disposition.

In the three-dimensional view of FIG. 1, a double-helix receptacle 10, illustrating a basic embodiment of the present invention, is shown above a cylindrical contact pin 12 shown mounted on a block representing a support base such as a portion of a male connector assembly or circuit board. Receptacle 10 is fabricated from a single length of wire, which may be a stripped portion of insulated hookup wire, formed into the configuration of an interleaved double-helix 14. The two wire portions 16A and 16B emerging from the bottom end of double-helix 14 are directed upwardly past diametrically opposite sides of the double-helix 14, and continue upwardly as portions 16C and 16D respectively, which are to be understood as typically extending to other circuit points as interconnections.

As part of the single continuous length of wire, the two interleaved coils of the double-helix 14 are integrally joined by a bridging loop 18 which diametrically transverses the upper end of the double-helix 14.

A key principle of the invention involves applying a rotational torque to loop 18, acting on the upper end of double-helix 14 about its concentric axis, while constraining its lower end at wire portions 16A and 16B, so as to deform e double-helix 14 in a manner to vary its inside diameter; for example expanding it to allow pin 12 to enter with zero insertion force, and then contracting it, either from external drive onto loop 18 or from internal spring stress in the wire, or a combination of both, to provide a working contact pressure onto pin 12. It is evident that the use of a single continuous length of wire accomplishes virtually perfect reliability of contact between the double-helix 14, which serves as the active receptacle contact element, and the two interconnecting wire portions 16C and 16D. In conventional forms of receptacle contacts, in a comparable configuration, the interconnecting leads require some form of connection to the contact member, such as soldering, crimping, riveting and the like, which typically introduce some degradation of reliability.

Figure 2:
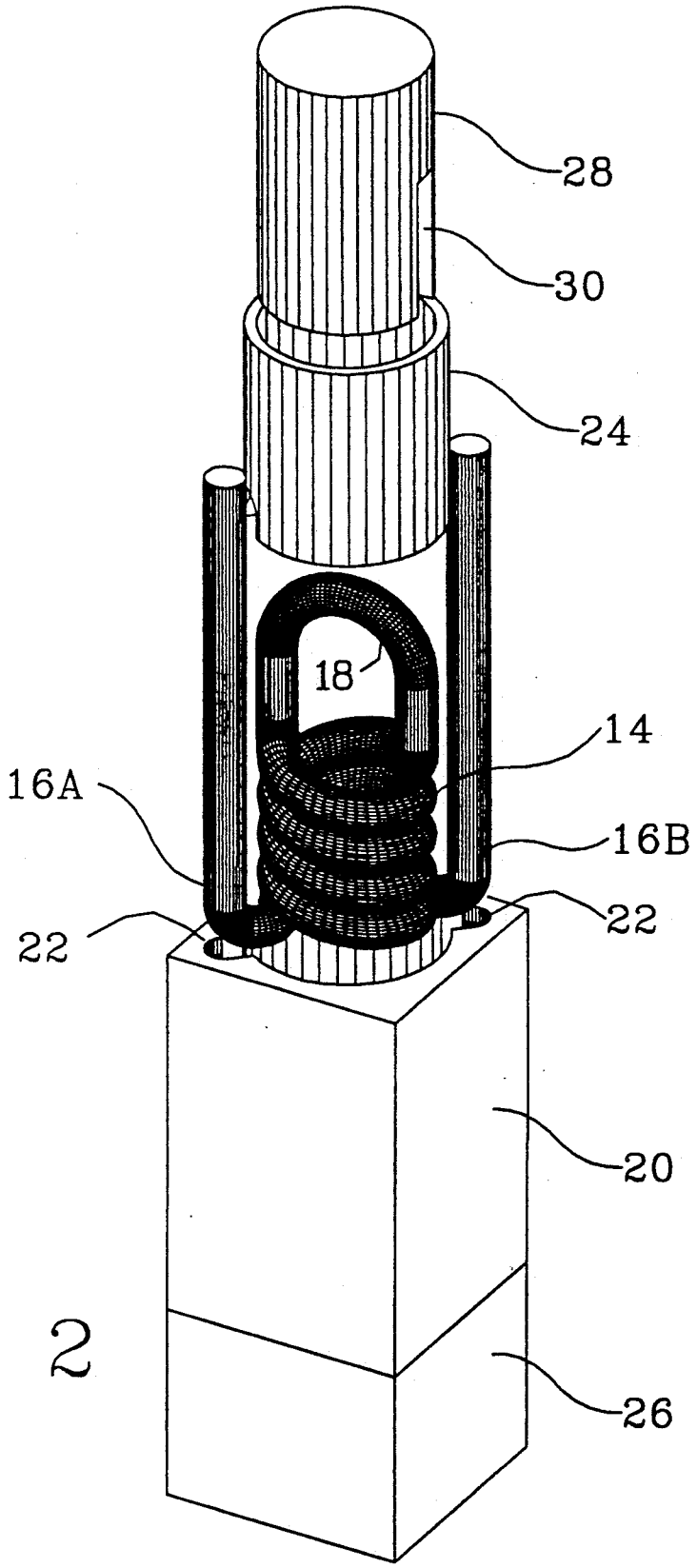
FIG. 2 shows an exploded view of an enclosed embodiment of this invention including the receptacle of FIG. 1.

FIG. 2 shows and exploded view of an enclosed connector receptacle 10A illustrating a preferred embodiment of the present invention. Shown below the double-helix 14 which has been described in connection with FIG. 1, is a casing 20, typically molded from an insulating plastic material and configured to have an internal cylindrical cavity somewhat larger than the outside diameter of double-helix 14. As indicated at the top surface of casing 20, the cylindrical cavity includes a pair of channels 22, each having a U-shaped cross-section, located and dimensioned to serve as conduits for lead wire portions 16A and 16B. A securing sleeve 24 shown above loop 18 is dimensioned to surround double-helix 14 and fit into the cylindrical cavity of casing 20.

At the bottom of casing 20 is shown an optional pin guide plate 26.

A cylindrical actuating drive head 28, shown above sleeve 24, is configured with a recessed region 30 dimensioned to engage loop 18. Drive head 28 may in some instances be made a part of receptacle 10A to serve as fixed or rotatable element. Alternatively drive head 26 may be made part of an external tool or drive mechanism which may be multiple and/or may include resilient coupling means.

The component shown are assembled by lowering double-helix 14 into casing 20 so that wire portions 16A and 16B enter and occupy channels 22 in the cavity of casing 20, thus constraining the lower end of double-helix 14 against rotation. Sleeve 24 is to be lowered over double-helix 14 so as to secure the double-helix 14 in place in the cavity and to retain wire portions 16A and 16B in place in channels 22.

In some instances a host circuit board will be utilized; typically such would be disposed on the top surface of casing 20 and would be provided with an opening matching the cross-sectional configuration of the cavity of casing 20 including channels 22.

Figure 3:
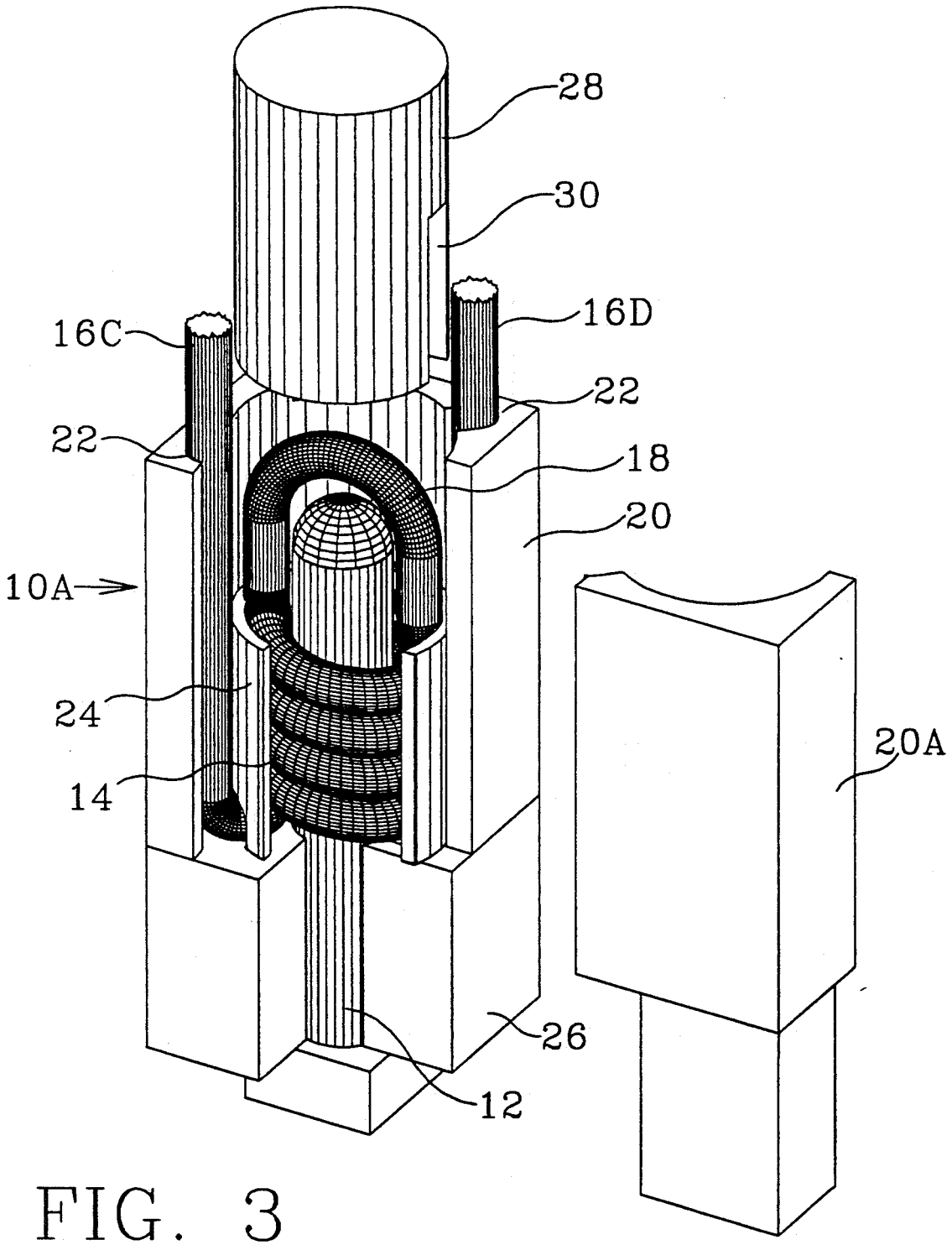
FIG. 3 shows a partial cutaway view of the items of FIG. 2 in assembled form engaging a pin contact member.

FIG. 3 shows the items of FIG. 2 in assembled form. Casing 20 is shown with portion 20A cut away and removed to show double-helix 14 contained within casing 20, surrounded by securing sleeve 24, and engaging a mating pin 12. The optional pin guide plate 26, shown below casing 20, provides a pin entry opening and serves as a protective measure to guide and position pin 12 upon entry.

With drive head 28 lowered into place engaging loop 18 in recess 30 in the manner of a dog clutch, torque received from drive head 28 will cause a slight rotation of the upper end of the double-helix 14, and since it is constrained at the lower end by the wire leads 16C and 16D captured in channels 22, the double-helix 14 will tend to expand or contract depending on the direction of the applied torque applied.

Typically double-helix 14 is dimensioned to have an inside diameter slightly smaller than the diameter of pin 12 in the absence of any applied torque. For contact pin insertion, sufficient torque is applied by drive head 28 in a counterclockwise direction to expand double-helix 14 so that pin 12 can be inserted with zero insertion force. Then, upon removal of applied torque, an internal torque from spring tension in the wire exerts a torque in the opposite direction onto the upper end of double-helix 14, contracting the double-helix 14 and clamping it around pin 12 to provide a working contact pressure.

Drive head 28 may be coupled to external drive mechanism to receive an external source of torque: this may take the form of an offset handle or crank, gears, wheels, belts, cams e or the like. In the case of multiple contact connectors the drive heads would receive torque from a suitable ganged mechanism; such a ganged configuration will preferably be provided with spring resilience in the linkage to each drive head so as to distribute the drive torque equally. The torque source may be designed to apply torque in either direction, i.e. an expansion-inducing torque or a contraction-inducing torque.

Depending on the particular application of the connector system drive head 28 may be designed to remain in place engaged on loop 18 and to exert contraction-inducing torque continuously as a supplement or alternative to the utilization of spring tension of the wire in double-helix 14 to provide contact pressure.

Figure 4:
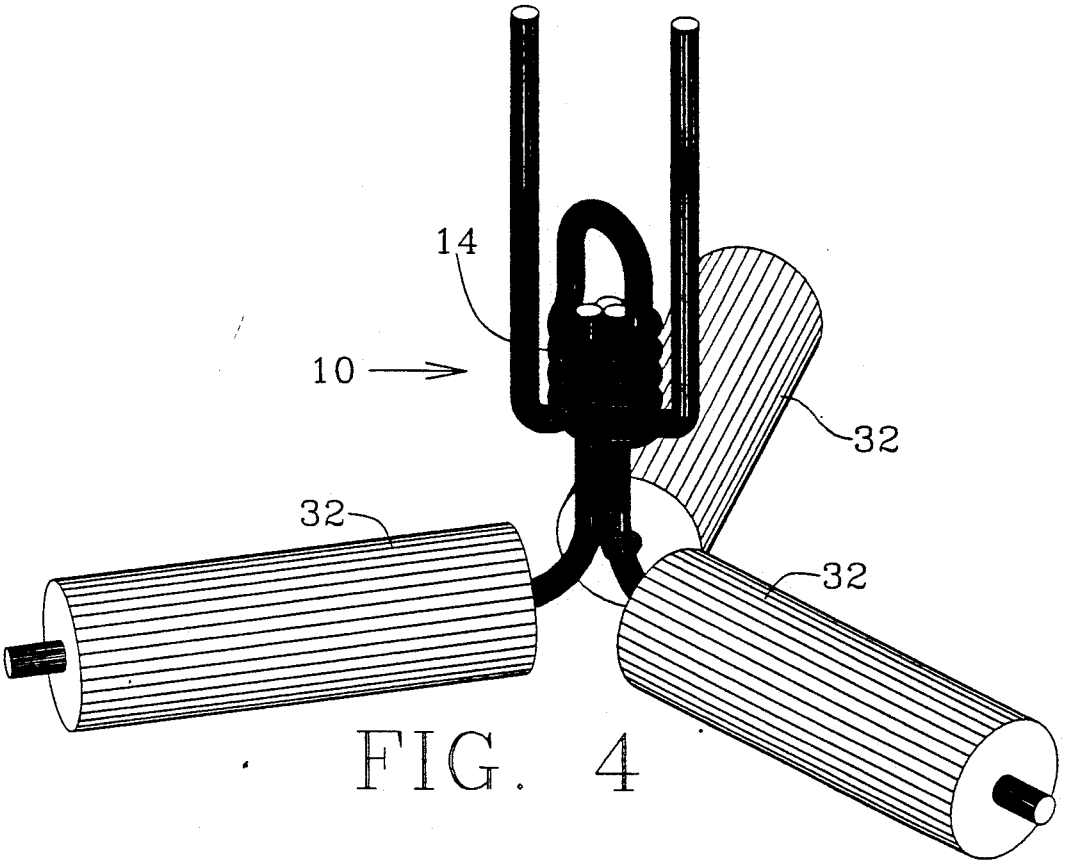
FIG. 4 shows a double helical receptacle of this invention utilized to clamp three lead wires.

FIG. 4 illustrates how a helical receptacle 10 of this invention may be utilized to join a plurality of component leads and/or hookup wire leads, in lieu of a solid pin as described heretofore. In this example, three stripped ends of insulated hookup wires 32 are engaged by double-helix 14. This configuration could be utilized in conjunction with a circuit board: wires 32 would typically be located on one side of the board with the stripped ends passing through a hole in the circuit board to the other side of the board carrying receptacle 10, which would be placed in position over the bundled wire ends and engaged in the general manner described above for a solid pin.

Figure 5:
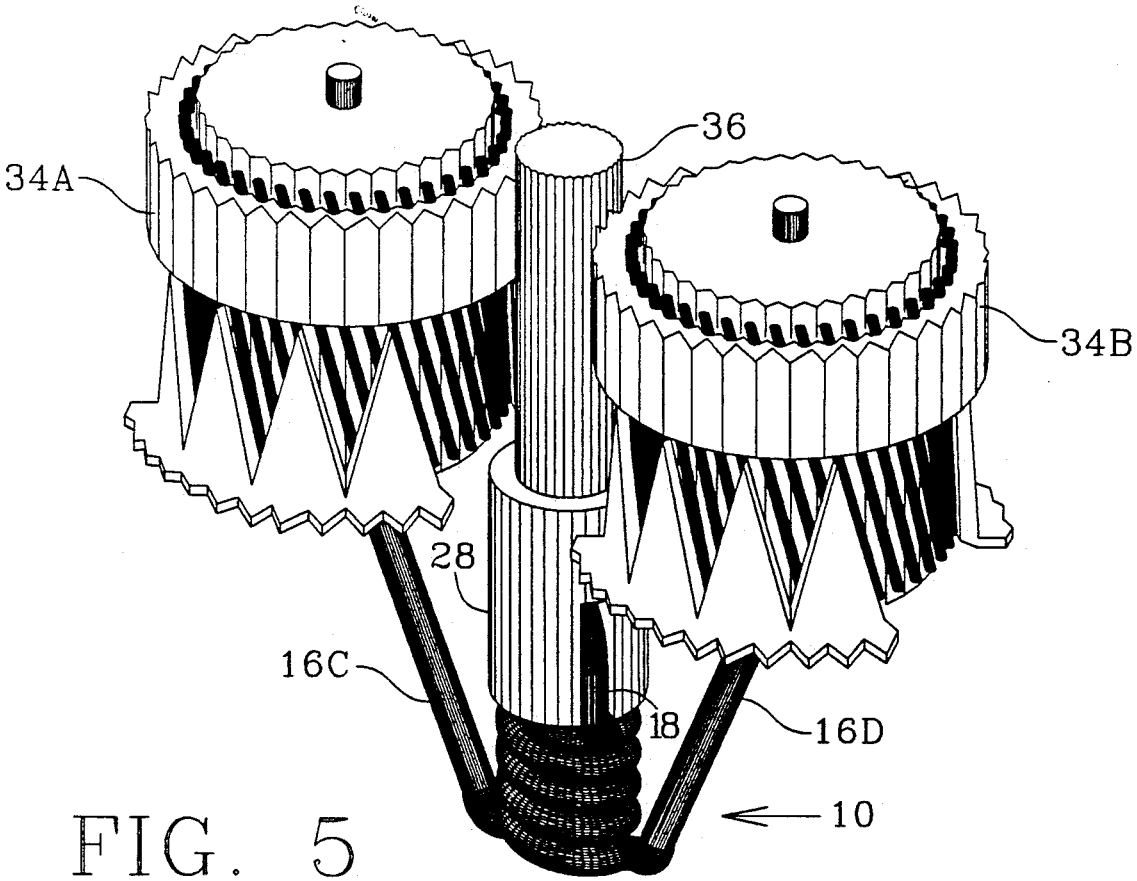
FIG. 5 shows a double helical receptacle of this invention formed from a stripped portion of coaxial cable, providing a connector junction terminal for two coaxial cable runs.

FIG. 5 shows a double helical receptacle 10 of this invention formed from a stripped portion of a coaxial cable. In this case, wire portions 16C and 16D are portions a bared center conductor of the coaxial cable of which two portions 34A and 34B are shown cut off at the upper end of the figure. Drive head 28 engages loop 18 of double-helix 14 which would typically accept a pin, wire or component lead at the bottom end in the manner described above in connection with FIGS. 1 through 4. Drive head 28 is coupled to an external torque source through drive linkage 36 which preferably includes resilient linkage such as a spring wire lever arm, which in some instances may be anchored in a spring-biased condition to act as the torque source.

With reference to FIGS. 4 and 5: as an alternative to the use of the double-helix receptacle 10 in the basic embodiment shown, an encased embodiment, receptacle 10A as shown in FIGS. 2 and 3 could be utilized.

Figure 6:
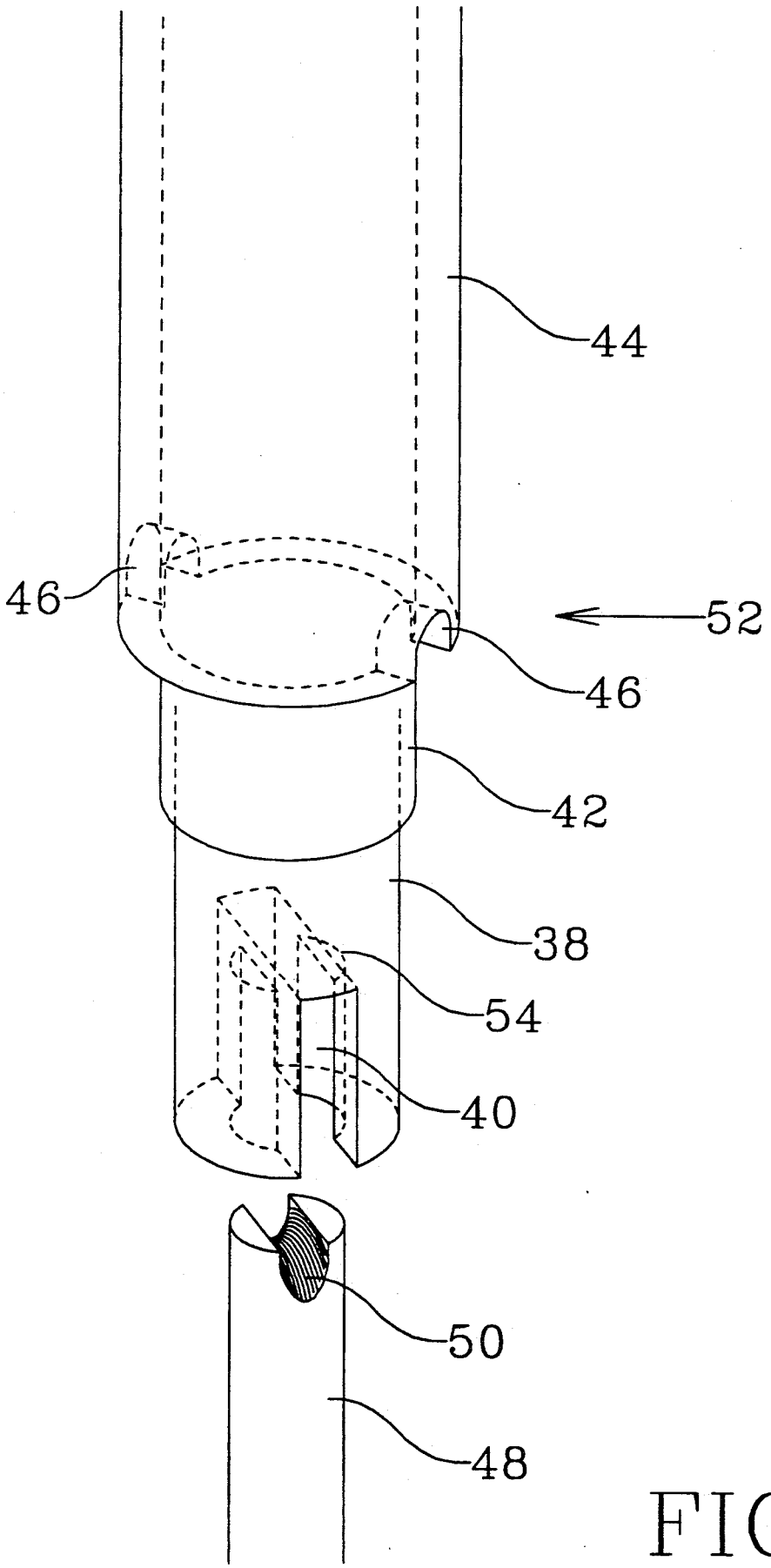
FIG. 6 shows a tool set for forming a double helical receptacle of this invention.

FIG. 6 is an isometric view of a four piece tool set for forming, from a continuous length of wire, a double-helical receptacle as described above. A female mandrel 38 with a loop-forming cavity 40, a loop-forming sleeve 42, and cylindrical sleeve guide 44 with wire clearance slots 46 are all made capable of vertical movement in a telescopic manner. The shaft of female mandrel 38 extends upwardly through guide 44, however for clarity some portions of hidden lines of shaft 38 and sleeve 42 are omitted.

A male mandrel 48 is also made capable of vertical movement. Both male mandrel 48 and female mandrel 38 are made capable of rotational movement. A loop-forming recess 50 of male mandrel 48 is aligned with slot 40 of female mandrel 38. In the female mandrel assembly 52, slots 46 on the cylindrical sleeve guide 44 provide final positioning of emerging double-helix wires after formation; limited rotational movement of guide 44 may be provided in some circumstances for this purpose. A mating cylindrical recessed region 54 is provided in female mandrel 38 to accept male mandrel 48.

FIGS. 7A–7E depict sequential steps in the process of forming a helical receptacle of this invention utilizing the tooling of FIG. 6. To preserve clarity, sleeve 42 and female mandrel 38 of FIG. 6 are not shown in some instances in FIGS. 7A–7E.

Figure 7A:
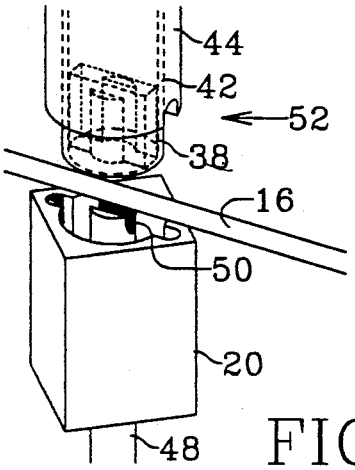
FIG. 7A–7F show successive steps in the forming of a double helical receptacle utilizing the tool set of FIG. 6.

In FIG. 7A, a wire 16, which may be a stripped portion of insulated hookup wire, is positioned across the top of a connector casing 20 (or on a host circuit board, when utilized, located on top of casing 20). Casing 20 is positioned in alignment beneath the female mandrel assembly 52 which comprises guide 44, along with sleeve 42 and female mandrel 38 indicated in hidden lines. Male mandrel 48 has ascended through the cavity in casing 20 to place loopforming recess 50 immediately beneath wire 16.

Figure 7B:
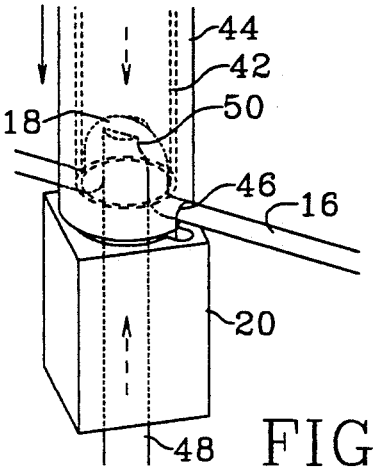

FIG. 7B shows (a) sleeve guide 44 having descended until the upper region of slot 46 contacts the upper surface of wire 16, (b) the sleeve 42, shown in hidden lines, and the female mandrel having descended until their lower surfaces contact the upper surface of wire 16, and (c) male mandrel 48, having ascended further to capture wire 16 into recess 50, continues to ascend to form a loop 18 in wire 16 as shown by hidden lines.

Figure 7C:
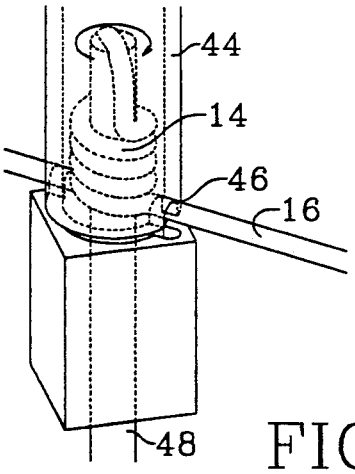

FIG. 7C depicts a subsequent point in the process: a double-helix 14 has been formed by a simultaneous and tandem action in which the female mandrel and male mandrel 48 rotate clockwise as indicated and both ascend at a predetermined rate to maintain the proper position of wire 16 relative to the vertical position of the loop forming region of the double-helix 14. The slots 46 of sleeve guide 44 remain stationary which also provides the proper overall alignment of wire 16 relative to the loop forming region of the double-helix 14.

Figure 7D:
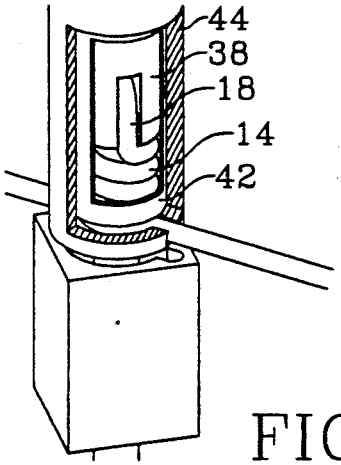

FIG. 7D is another representation of FIG. 7C with a section of sleeve guide 44 and sleeve 42 cut away to better depict the positioning of female mandrel 38, sleeve 42 and the formed loop 18 of double-helix 14.

Figure 7E:
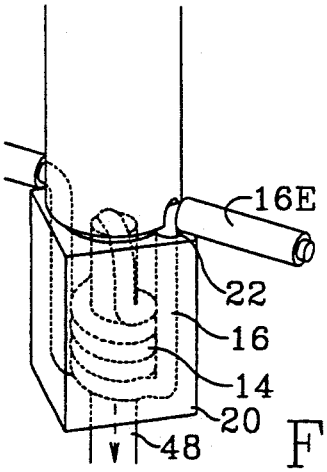

FIG. 7E depicts a subsequent point in the process where double-helix 14 has been inserted into the cavity of casing 20 by descending movement of sleeve, female mandrel and male mandrel 48 in a simultaneous and tandem action. The remaining portion of stripped wire 16 is placed into the wire channels 22 during the descent of double-helix 14, such that, upon the final placement of double-helix 14, the ends of the insulated portion of wire 16E are located at the upper entrance of the wire channels 22.

After this step, the sleeve ascends, the female mandrel ascends and male mandrel 48 descends.

Figure 7F:
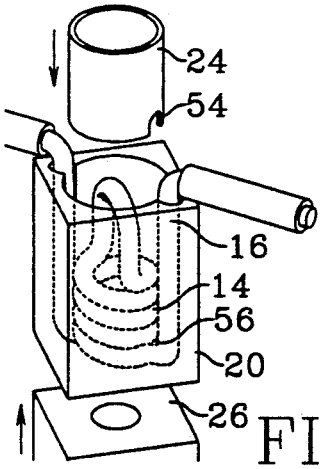

In FIG. 7F, following withdrawal of the mandrel tool set, the double-helix 14 is secured within the cavity of casing 20 by inserting securing sleeve 24 into the cavity until slot 54 of securing sleeve 24 contacts the bend 56 of double-helix 14. Securing sleeve 24, surrounding double-helix 14, separates double-helix 14 from the interconnecting wire 16 in the wire channel. The optional pin guide plate 26 may be affixed at the bottom side to protect the double-helix 14 from possible damage from entry of a pin or component lead.

Alternative methods may be utilized for securing the double-helix 14 within the cavity; for example double-helix 14 may be slightly twisted thereby deforming a portion of the bend 56 of the double-helix 14 and subsequently locking it into place by suitable means such as the placement of pin entry plate 26.

The method of double-helix formation taught by this invention can be utilized in conjunction with the forming of twisted pair wiring in accordance with the method disclosed in U.S. Pat. No. 5,042,146.

The connector of this invention may be utilized in conjunction with pins of other cross sectional shape as well as the round shape shown: for example with a pin of rectangular (including square) cross-section, where, for purposes of sizing, a diagonal would be taken as the equivalent effective diameter of the pin.

In addition to the mode of operation described above for the illustrative embodiment wherein spring properties of the wire in the double-helix are relied upon, at least in part, to maintain working contract pressure, there exists the option of designing the connector system such that the working torque for maintaining contact pressure is received by the double-helix primarily via the drive head which would be held in engagement with the loop, continuously transmitting a contraction-inducing torque, typically via a spring linkage member adapted to maintain relatively constant torque (and thus contact pressure) dynamically. Such a mode will reduce or eliminate dependency on spring properties in the wire, for example allowing the use of soft copper wire.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. An electrical connector receptacle of the zero insertion force type, for engagement with an elongated mating connector pin having a designated effective diameter, the receptacle comprising:

a double-helix formed as two interleaved helical coils from a single length of wire so as to provide at a first end thereof a diametric loop, formed integrally from the wire, connecting the two coils together and to provide at a second and opposite end thereof a pair of wire portions for external connection, said double-helix being made to have an initial internal diameter lesser than the pin diameter by a predetermined margin;

mounting means adapted to constrain the second end of said double-helix against rotation about a concentric axis thereof;

a first torque source adapted to apply an expansion-inducing torque to said double-helix via said loop, so as to at least temporarily expand said double-helix to have a designated effective inside diameter exceeding the effective pin diameter by a predetermined clearance margin and to thus enable insertion of the pin into the double-helix with a substantially zero insertion force requirement; and a second torque source, acting, in a rotational direction opposite that of said first torque source, adapted to apply a contraction-inducing torque to said double-helix, about the concentric axis thereof, such that, with the mating connector pin matedly disposed within said double-helix, said coils are caused to become compressed about the pin and to thus provide continuous electrical contact between the pin and said double-helix.

2. The electrical connector receptacle as defined in claim 1 wherein said first torque source is enabled to additionally expand said double-helix, in the manner described heretofore, sufficiently to enable withdrawal of the pin therefrom with a substantially zero withdrawal force requirement.

3. The electrical connector receptacle as defined in claim 1 wherein said second torque source comprises internal spring bias of the wire in said double-helix, said wire being made from resilient metal and said double helix being made to have an initial inside diameter smaller than the effective pin diameter such that, subsequent to insertion of the pin into said double-helix and removal of said expansion-inducing torque, said double-helix is caused to remain spring-biased internally and to thus apply the contraction-inducing torque and thus provide said continuous electrical contact between the pin and said double-helix.

4. The electrical connector receptacle as defined in claim 1 further comprising a slotted drive head, operationally coupled to said first torque source, adapted to engage said diametric loop and to apply thereto said expansion-inducing torque.

5. The electrical connector receptacle as defined in claim 4 wherein said drive head is further adapted to continuously apply at least some portion of said contraction-inducing torque to said double-helix, thus providing at least some portion of total pressure contact in said continuous electrical contact between the pin and said double-helix.

6. The electrical connector receptacle as defined in claim 1 wherein said mounting means comprises:

a casing, surrounding and supporting said double-helix; and two conduits, adapted to contain said connecting wires, configured as cavity regions of said casing, located one on each of two opposite sides of said casing and extending substantially from the first end to the second end of said double-helix.

7. The electrical connector receptacle as defined in claim 6 further comprising a cylindrical sleeve surrounding said double-helix and disposed between said double-helix and said connecting wires in a manner to secure said double-helix and said connecting wires within said casing.

8. An electrical connector receptacle of the zero insertion force type, for engagement with an elongated mating connector pin having a designated effective diameter, the receptacle comprising:

a double-helix formed from a single length of resilient wire so as to constitute two interleaved helical coils having a central cavity defining a cylindrical female contact member having an inside diameter smaller than the specified pin diameter by a predetermined margin and to provide at a first end thereof a pair of wire portions for external connection and at a second and opposite end thereof a diametric loop, formed from the wire, integrally connecting the two coils together;

said double-helix being mounted in a manner to constrain the first end thereof against rotation and to enable rotation of the second end thereof due to an expansion-inducing torque received via the loop from a drive head engaged therewith, such as to cause said double-helix to expand circumferentially to an inside diameter exceeding the designated effective pin diameter sufficiently to enable insertion of the pin into the double-helix with substantially zero insertion force, whereby, upon subsequent discontinuation of the torque, the double-helix is enabled to contract circumferentially due to resilience of the wire until the double-helix becomes compressed radially onto the pin thus providing continuous electrical contact therewith.

9. A method of making and using a double-helix of wire to serve as an electrical receptacle for mating cooperation with a contact pin of specified effective diameter in a zero insertion force type electrical connector system, comprising the steps of;

forming the double-helix from a single length of resilient wire so as to constitute two interleaved helical coils having a central cavity constituting a female contact member having an inside diameter smaller than the specified pin diameter by a predetermined margin, the wire being formed at a first end of said double-helix to define a diametric loop integrally connecting the two coils together;

shaping the wire at a second end of the double-helix opposite the first end thereof to form a pair of wire portions thereof adapted to serve as external interconnections;

mounting the double-helix in a manner to constrain the second end thereof against rotation about a concentric axis thereof;

engaging the diametric loop with a recessed drive head; and applying an expansion-inducing torque via the drive head so as to rotate the loop about a concentric axis in a manner to expand the double-helix until the inside diameter thereof exceeds the pin diameter such that the pin can be inserted therein with substantially zero insertion force;

inserting said pin into the cavity said double-helix to a mated disposition;

discontinuing the rotational torque, thereby enabling said double-helix to decrease in inside diameter due to the resilience of the wire until the double-helix becomes compressed radially onto the pin thus providing electrical contact therewith.

10. The method of making and using a double-helix of wire to serve as an electrical receptacle as defined in claim 9 comprising the further step of applying a contraction-inducing torque to the loop via the drive head in a direction to further compress the double helix around the pin, whereby the connector system is provided with increased contact pressure.

11. A coaxial mandrel fabrication tool set for forming a designated portion of a single length of wire into a double-helix to serve as a receptacle contact of a zero force insertion type connector system, comprising:

an elongated cylindrical male mandrel, having an outside diameter made smaller than a designated coil inside diameter, adapted to receive rotational drive and longitudinal displacement at a first end, and having at a second end a diametric recess shaped to form a central portion of the wire into a U shaped loop;

an elongated cylindrical female mandrel, having an outside diameter made substantially equal to a designated coil outside diameter, having at a first end facing the second end of said male mandrel, a loop-forming cavity adapted to receive a portion of the second end of the male mandrel, and having a second end adapted to receive longitudinal displacement along the axis and to rotate synchronously about the axis with the male mandrel, the loop-forming cavity being shaped to cooperate with said male mandrel in forming the U shaped loop;

a thin-walled tubular loop-forming sleeve, fitted in close movable relationship around said female mandrel, adapted to receive longitudinal displacement and to peripherally support a double-helical workpiece in process, acting as an interim spacer to prepare the workpiece for installation of an insulating securing sleeve in final assembly; and a tubular outer sleeve guide, fitted in close movable relationship around said loop-forming sleeve, having at a first end facing said male mandrel a pair of U shaped wire clearance slots disposed at diametrically opposed points of the first end, said sleeve guide being adapted to receive longitudinal displacement along the axis while being constrained rotationally, and to captivate wire portions adjacent to a double-helical work piece in process so to guide wire portions moving into the work piece in process of winding the double-helical workpiece by rotation of said male mandrel along with said female mandrel.

12. A method of forming a portion of a continuous wire into a double-helix to serve as a contact receptacle in a zero insertion force electrical connector system, the method comprising the steps of:

placing a casing, configured with a substantially cylindrical cavity sized to surround a double-helix, concentrically around an elongated cylindrical male mandrel facing upwardly and adapted to rotate about a central axis and to receive longitudinal displacement;

placing the portion of wire to be formed across the top of the casing and the male mandrel, aligned with a groove provided diametrically across the top end of the male mandrel;

lowering onto the wire a three-part female mandrel tool set comprising (a) an inner elongated cylindrical female mandrel, having a diameter approximating that of the double-helix to be formed and having at its lower end a loop-forming cavity, the female mandrel being adapted to rotate along with the male mandrel, (b) a thin-walled tubular loop-forming sleeve fitted movably around the female mandrel and (c) a tubular outer sleeve guard fitted movable around the loop-forming sleeve, constrained against rotation and configured at the bottom end with a pair of diametrically opposed U shaped slots which are lowered onto the wire so as to act as a fixed guide for wire entry; the female mandrel, loop-forming sleeve and the outer sleeve all being adapted to receive longitudinal displacement along the central axis;

lowering the female mandrel and raising the male mandrel to mate together and to captivate the wire within the loop forming cavity of the female mandrel;

raising the mated male and female mandrels so as to form the wire into a loop of predetermined height;

rotating the male and female mandrel together so as to draw wire in through the U shaped slots while winding the wire into two interleaved coils of a double-helix, while simultaneously raising the mated male and female mandrels as required during winding;

inserting the formed double-helix into a final position;

securing the formed double-helix within the casing;

raising the female tool set clear of the formed double-helix; and lowering the male mandrel clear from the formed double-helix.

* * * * *